US006173834B1

(12) United States Patent
Voden et al.

(10) Patent No.: US 6,173,834 B1
(45) **Date of Patent: *Jan. 16, 2001**

(54) TRANSPARENT DART CASE HAVING UNITARY CONSTRUCTION

(75) Inventors: Derick L. Voden, Milwaukee; Justin L. Voden, Waukesha, both of WI (US)

(73) Assignee: Great Lakes Dart Mfg., Inc., Muskego, WI (US)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 08/987,680

(22) Filed: Dec. 9, 1997

(51) Int. Cl.[7] ..... B65D 85/20; B65D 69/00; B65D 51/04

(52) U.S. Cl. ..... 206/315.1; 206/443; 206/579; 220/839

(58) Field of Search ..... 206/315.1, 806, 206/579, 443, 526, 470; 220/339, 4.22, 4.23, 839; D9/415

(56) References Cited

U.S. PATENT DOCUMENTS

| | | | | |
|---|---|---|---|---|
| D. 343,575 | * | 1/1994 | Edelson | D9/415 |
| 2,687,157 | * | 8/1954 | Cowan | 220/339 X |
| 3,043,354 | * | 7/1962 | Fitzgerald | 220/339 X |
| 3,648,400 | * | 3/1972 | Wolfe | 220/339 X |
| 3,952,873 | * | 4/1976 | Pampuch et al. | 220/339 X |
| 3,960,271 | | 6/1976 | Nelson . | |
| 4,349,102 | * | 9/1982 | Strongwater | 206/806 X |
| 4,632,242 | * | 12/1986 | Choi et al. | 206/806 X |
| 4,773,578 | | 9/1988 | Braun . | |
| 4,884,718 | * | 12/1989 | Leahy | 220/339 |
| 5,046,659 | * | 9/1991 | Warburton | 220/4.23 X |
| 5,067,610 | | 11/1991 | Jensen . | |
| 5,071,005 | * | 12/1991 | Hemmings et al. | 206/379 |
| 5,165,537 | | 11/1992 | Neff et al. . | |
| 5,238,108 | | 8/1993 | Velezis et al. . | |
| 5,450,992 | | 9/1995 | Coffee . | |
| 5,522,508 | * | 6/1996 | Pesota | 206/579 |
| 5,533,625 | | 7/1996 | Mikkelsen . | |
| 5,586,677 | * | 12/1996 | Foos | 220/339 X |

FOREIGN PATENT DOCUMENTS

| | | | | |
|---|---|---|---|---|
| 1122607 | * | 9/1956 | (FR) | 206/1.8 |
| 1480373 | * | 5/1967 | (FR) | 206/806 |
| 1583862 | * | 2/1981 | (GB) | 220/339 |

* cited by examiner

*Primary Examiner*—Bryon P. Gehman
(74) *Attorney, Agent, or Firm*—Cook & Franke S.C.; Timothy J. Ziolkowski

(57) ABSTRACT

The present invention includes a transparent dart case of one-piece design that is capable of securing darts, spare dart components and a tool for use in assembling darts. The present invention includes an integrally molded and removable hanging bracket that allows the dart case to be mounted on a rack for display without any additional packaging. The integrally molded bracket can be easily removed with minimal force after it is purchased. The present invention has a transparent first frame which is connected to a transparent second frame by a living hinge. Both the first frame and the second frame have a side wall which are mated together to form an enclosure which has sufficient integrity to protect and transport darts, dart components and dart assembly tools. The assembly is molded as an integral unit using a K-resin to provide ideal clarity.

54 Claims, 4 Drawing Sheets

FIG. 3
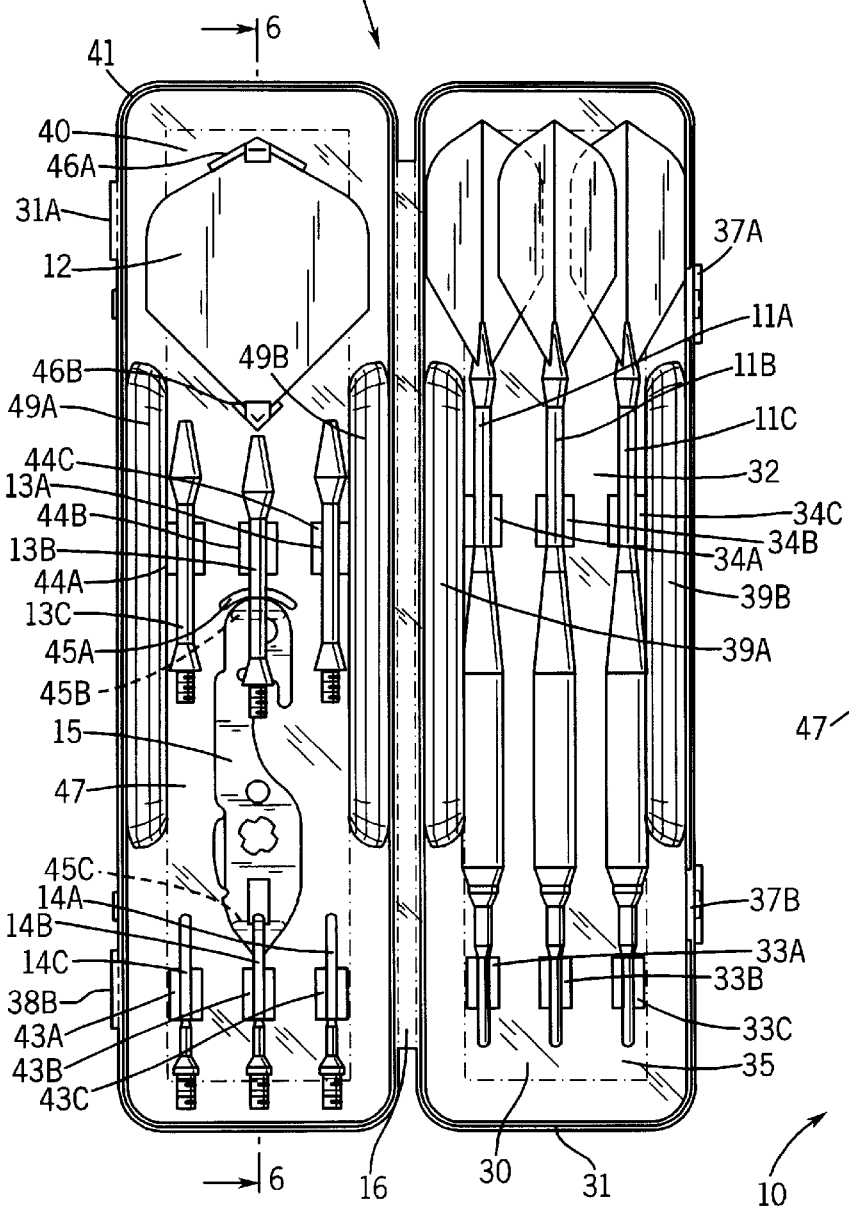
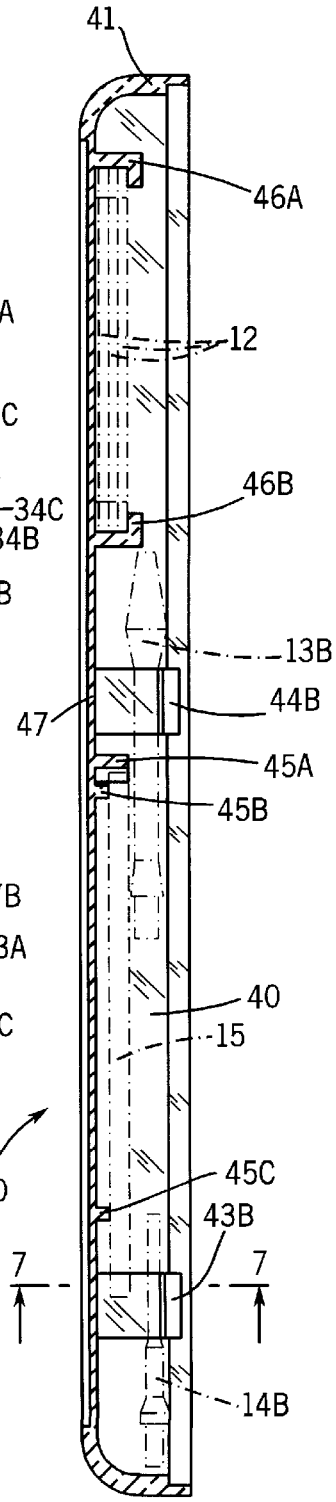
FIG. 6
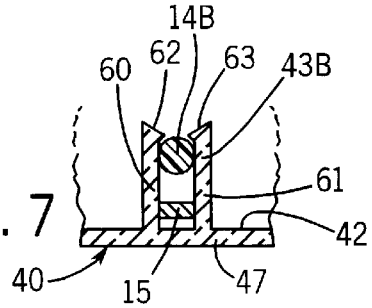
FIG. 7

TRANSPARENT DART CASE HAVING UNITARY CONSTRUCTION

BACKGROUND OF THE INVENTION

This invention relates generally to a dart case, and more particularly to a transparent one-piece dart case for storing darts, dart components and dart assembly tools.

Conventional dart cases are often cumbersome to use because most are opaque and do not allow a user to see the contents unless opened. Some provide a window or have only one section which is partially transparent. However, a user is still required to either open, or physically orient the case in order to visually inspect the contents of the case, and usually cannot see the entire contents without opening the case. Such a limitation is not only time consuming and annoying, it also leads to misidentification, especially when an individual needs to identify a particular set of darts contained in a dart case which may be stored among several dart cases. In addition, such partially transparent dart cases have conventionally been constructed of several different pieces which require assembly, thereby increasing manufacturing costs. Other cases that are more fully transparent are constructed with elaborate hinges and have multiple pieces which are also not only time consuming to construct, the individual pieces are expensive to make.

Another difficulty which currently exists with conventional dart cases is that additional packaging or hanging brackets are required in order to display the dart case on a rack. These additional packaging and brackets increase the cost associated with the dart case and lead to unnecessary waste. Additionally, such cases that are not fully transparent either must be displayed in an open position, thereby requiring additional packaging, or closed, preventing prospective purchasers from inspecting the contents and/or the interior configuration.

Conventional dart cases also only secure darts and/or dart components. Dart components, such as shafts, are known to have been assembled on darts by using spare tips as a type of wrench to apply torque as necessary to tighten the assembly. This type of assembly can cause damage to the spare tips. Further, the technology associated with dart fabrication has increased the number of precision components, and some dart enthusiasts just prefer not to use tips as wrenches. The amount of effort required to assemble and disassemble darts has also increased. Therefore, special tools are now desired to facilitate the assembly and disassembly of various dart components and conventional cases do not provide a means for securing these tools.

One attempt at providing a transparent case is disclosed in U.S. Pat. No. 5,165,537. This patent involves a dart carrying and display case having a transparent cover pivotally mounted to an opaque dart carrying section. This particular dart carrying case is also comprised of several different pieces which require assembly. Such a case does not allow a user to examine the contents of the case from a variety of orientations while the case is closed and is relatively expensive to produce.

Another dart case, disclosed in U.S. Pat. No. 5,450,922, provides an opaque cover and an opaque base connected via a hinge means. This dart case is only capable of securing darts and storing dart components, has no tool retaining members, and is not transparent. Another dart case is disclosed in U.S. Pat. No. 5,238,108 which has a base member, a hinged cover member and a latch. The base member and hinged cover of this multiple-piece dart case are opaque and the case has no means for retaining dart assembly tools.

Further examples of prior art dart cases include U.S. Pat. Nos. 5,533,625, 5,067,610, 4,773,578 and 3,960,271. However, none of these references provide a transparent, one-piece dart case that allows an individual to view the contents of the case from a variety of orientations while the case is closed. None can adequately secure dart assembly tools within the case in addition to holding darts and dart components, and none are capable of hanging from a rack, or some other device, for display without additional packaging or non-integral hanging members. All of which are desired features of an inexpensive dart case by dart enthusiasts.

SUMMARY OF THE INVENTION

The present invention overcomes the aforementioned problems by providing a transparent dart case of one-piece design. In addition, the present invention also secures assembly tools within the dart case, as well as providing secure storage for the corresponding darts and dart components. The present invention also allows the dart case to be mounted directly onto a rack for display without any additional pieces and/or packaging.

The dart case of the present invention is a unitary molded case having a transparent first frame which has a back wall with an inside surface that is bounded by a side wall. The dart case also includes a transparent second frame which has a front wall with an inside surface that is bounded by another side wall. The first and second frames are integrally molded and attached by a living hinge. A portion of the side wall of the first frame is connected to a portion of the side wall of the second frame by the living hinge. The living hinge allows the first frame and second frame to remain connected as a one-piece assembly, while still allowing relative movement between the first frame and second frame such that the case can be opened and closed. When the side walls are mated together, an enclosure is formed that has sufficient integrity to protect and transport darts, dart components and at least one dart assembly tool.

The dart case also includes at least one elastic clamp which is capable of securing either darts, dart components and/or dart assembly tools. In addition, at least one fastener is attached to the side wall of the first frame which joins with another fastener attached to the side wall of the second frame so that the first frame and the second frame can be secured in a closed position.

The dart case of the present invention may also comprise a hanging bracket which is integrally molded with the case. The hanging bracket allows the dart case to be placed on a rack for display and is intended to be easily removed with minimal force after purchase, thereby eliminating unnecessary packaging.

One object of the present invention is to provide a one-piece dart case that can be completely transparent so that an individual can inspect the contents of the case from virtually any orientation.

An additional object of the invention is to provide a dart case which allows for securing dart assembly tools within the case along with the darts and dart components.

Another object of the invention is to provide a dart case with a removable hanging bracket molded integrally with the case which is directly mountable to a rack, or some other device, in order to place the case on display for sale without any additional pieces and/or packaging.

Various other features, objects, and advantages of the present invention will be made apparent from the following detailed description and the drawings.

BRIEF DESCRIPTION OF THE DRAWINGS

The drawings illustrate the best mode presently contemplated for carrying out the invention.

In the drawings:

FIG. 3 is a front view of the dart case of FIG. 1 in the open position with darts, dart components and a dart assembly tool mounted within the case.

FIG. 6 is a sectional view taken along line 6—6 of FIG. 3.

FIG. 7 is a sectional view taken along line 7—7 of FIG. 6.

DETAILED DESCRIPTION OF THE PREFERRED EMBODIMENT

Figure 1:
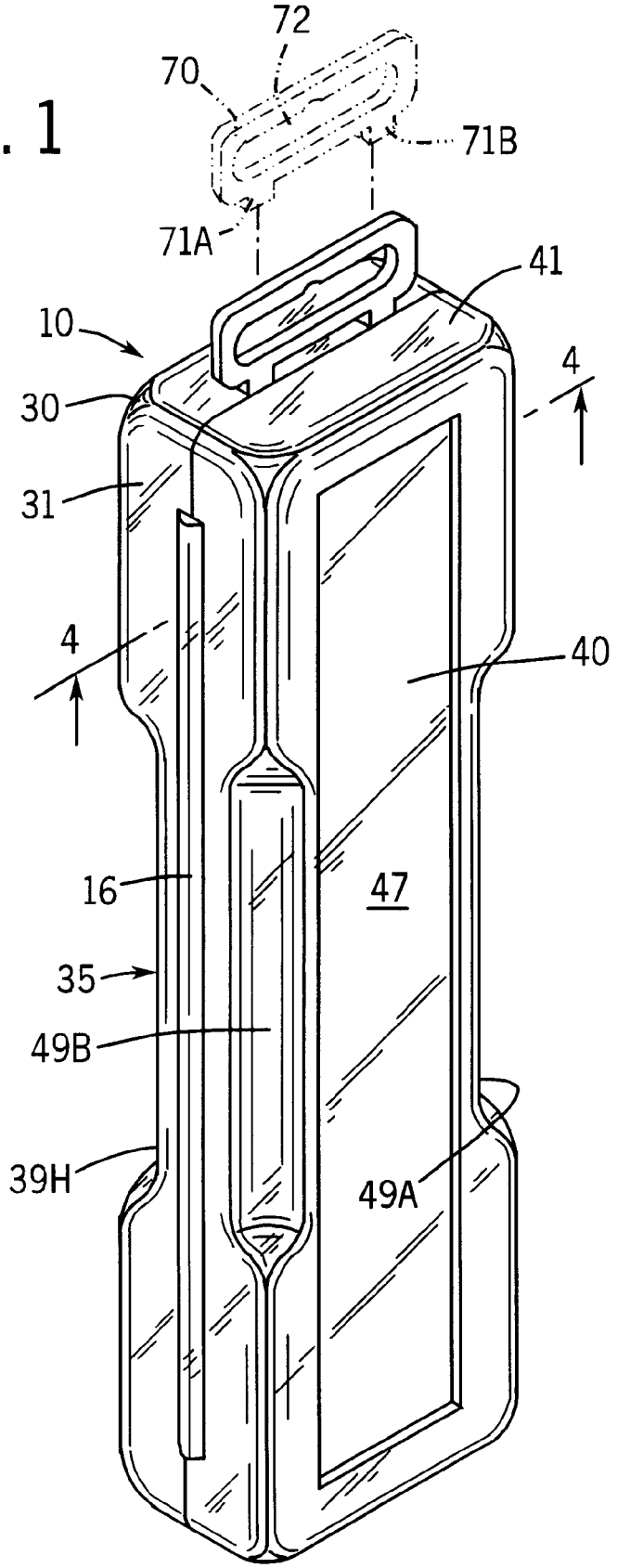
FIG. 1 is a perspective view of a dart case according to the present invention with the dart case in a closed position.

Referring now particularly to FIG. 1, dart case 10 includes a first frame 30 which has back wall 35 surrounded by side wall 31. First frame 30 is attached to a second frame 40 which has a top wall 47 surrounded by side wall 41. The edges of side wall 40 and side wall 41 are preferably similarly shaped such that when side wall 40 and side wall 41 are mated an enclosure is formed having a consistent top and bottom.

Dart case 10 is a one-piece molded design, preferably made from a plastic which is transparent after molding in order to allow inspection of the contents of dart case 10 from a variety of orientations when dart case 10 is closed. The plastic is preferably a styrene butadiene block copolymer, such as K-Resin KR01 available from Phillips Chemical Company. In a preferred embodiment, side wall 31 and side wall 41 may be semi-transparent for aesthetic appearance.

Preferably, the present invention also includes hanging bracket 70 which is integrally molded to either first frame 30 or second frame 40. Hanging bracket 70 includes opening 72 such that dart case 10 may be hung on a rack for display. Hanging bracket 70 is preferably attached at two sections 71A, 71B which are designed to allow hanging bracket 70 to be easily removed from dart case 10 once displaying dart case 10 is no longer necessary.

Although various shapes are contemplated, side walls 31 and 41 are preferably curved and the dart case 10 is generally rectangular shaped with side wall indentations 39A, 39B in side wall 31 and side wall indentions 49A, 49B in side wall 41 to facilitate gripping first frame 30 and second frame 40 for opening and closing dart case 10 and for aesthetic appearance. The edges of side wall 31 and side wall 41 may be notched, beveled, chamfered or slotted to facilitate mating side wall 31 with side wall 41 and improving the sealing integrity of dart case 10 in the closed position.

Figure 2:
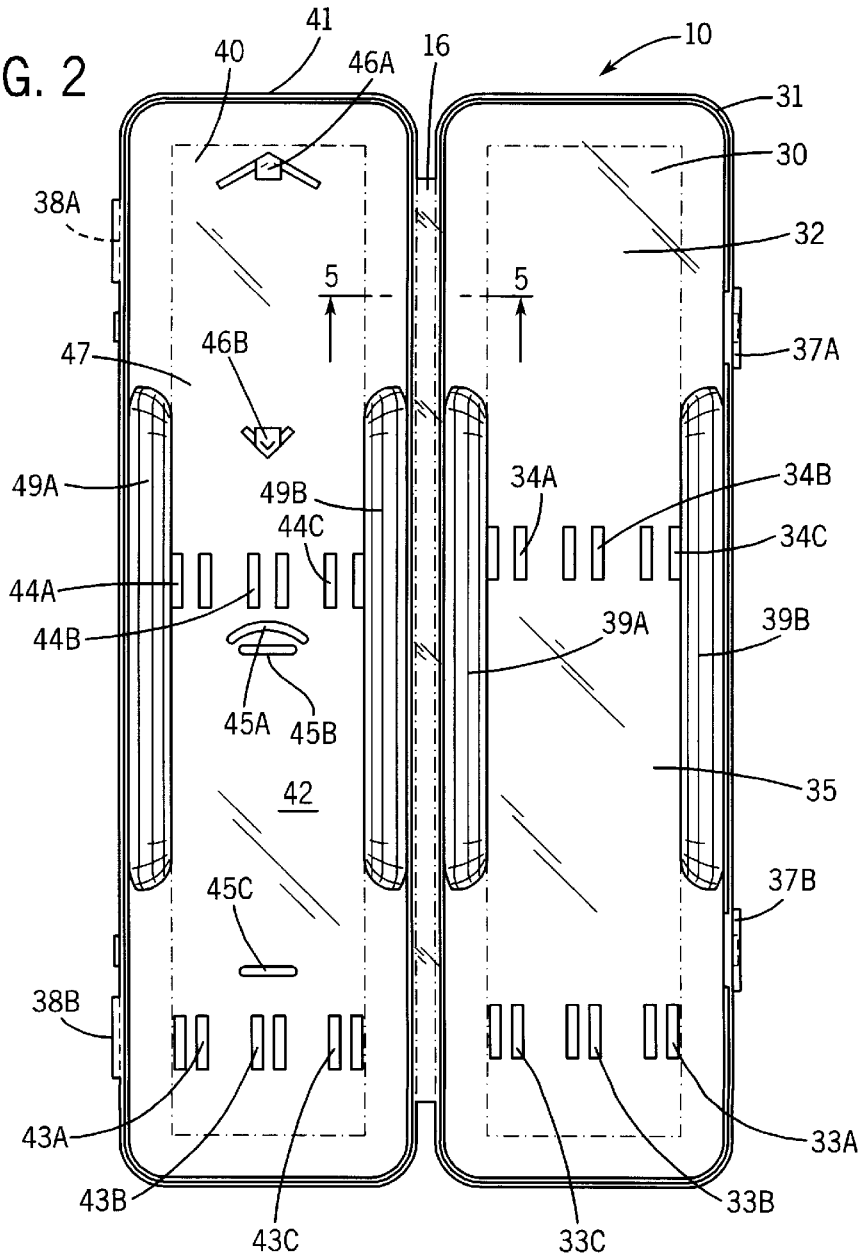
FIG. 2 is a front view of the dart case of FIG. 1 with the dart case in an open position.

FIG. 2 shows dart case 10 in an open position having at least one elastic clamp which extending outwardly from inside surface 32 of back wall 35 and/or inside surface 42 of front wall 47. These clamps are capable of securing a dart, dart component and/or dart assembly tool to dart case 10. Dart case 10 includes elastic clamps 33A, 33B, and 33C extending outwardly from inside surface 32 and sized to retain one end of an assembled dart. Clamps 34A, 34B, and 34C also extend outwardly from inside surface 32 and are sized to retain a body section of the dart at an opposite end. Inside surface 42 has retaining clamps 43A, 43B, and 43C extending outwardly therefrom, and sized to retain spare parts, such as tips. Clamps 44A, 44B, and 44C are sized similar to clamps 34A–C, and are for holding spare dart shafts. Outwardly extending protrusions 45A, 45B, and 45C are used for wrench placement and protrusions 46A and 46B retain spare flights therein.

Dart case 10 also includes two fasteners 37A and 37B integrally molded with side wall 31 of first frame 30 to join with two fasteners 38A and 38B that are integrally molded with side wall 41 of second frame 40 in order to secure first frame 30 to second frame 40 so that dart case 10 can be secured in the closed position.

Referring now to FIG.3, dart case 10 is shown securing darts 11A, 11B, and 11C within the aforementioned elastic clamps 33A–C and 34A–C. Spare dart flights 12 are retained within the outwardly extending protrusions 46A and 46B, and spare dart shafts 13A, 13B, and 13C are retained within clamps 44A–C. Spare dart tips 14A, 14B, and 14C are retained within clamps 43A–C. A dart wrench tool 15 is held in place by the outwardly extending protrusions 45A–C, along with a spare tip 14B and a spare shaft 13B. When dart case 10 is closed, the contents of the dart case 10 are viewable from the exterior and each has an appropriate storage means.

Figure 5:
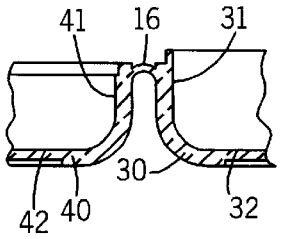
FIG. 5 is a sectional view taken along line 5—5 of FIG. 2.
Figure 4:
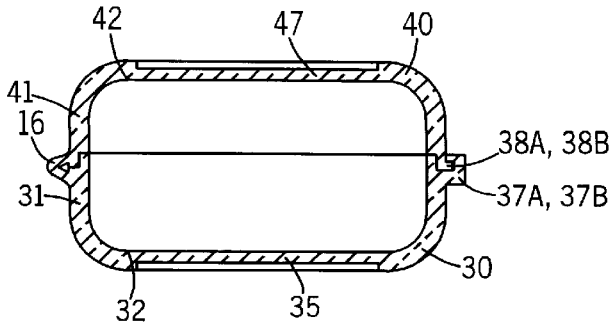
FIG. 4 is a sectional view taken along line 4—4 of FIG. 1.

Turning to FIG. 4, a detailed cross sectional view of case 10 is shown in a closed position. Side wall 31 is fastened to side wall 41 with fastener sections 37A, 37B which are aligned with and snapped to fastener sections 38A, 38B of side wall 41 in order to securely fasten dart case 10 in the closed position. First frame 30 and second frame 40 are preferably attached by a living hinge 16. As best shown in FIG. 5, living hinge 16 connects a portion of the edge of side wall 31 with a portion of the edge of side wall 41 to allow for relative motion between first frame 30 and second frame 40 so that dart case 10 can be opened and closed and molded as one piece.

FIG. 6 shows a side view of the dart case 10 with dart wrench 15 secured to second frame 40. The dart wrench 15 is held stationary by dart shaft 13B, dart tip 14B and outwardly extending protrusions 45A–C, which are integrally molded in dart case 10. The outwardly extending protrusions 45A–C include an arcing member 45A extending upwardly from the inside surface of the second frame 40 and arranged to support an upper portion of the dart wrench tool 15, and a pair of tool supports 45B and 45C located laterally from and adjacent the arcing member 45A. The tool supports 45B and 45C extend outwardly from the inside surface of the second frame 40 and are arranged to support the tool a spaced distance above the inside surface; A number of spare flights 12 are held firmly in place by retainers 46A and 46B, which are preferably integrally molded protrusions which extend from inner surface 42 of front wall 47 and comprise a v-shaped member and a retention cap overlaying and extending inwardly from the v-shaped member. Dart flights 12 are compressed flat and fit underneath each protrusions 46A and 46B to secure the dart flights 12 to dart case 10.

FIG. 7 shows a detail of an exemplary elastic clamp 43B which is integrally molded to dart case 10. The other clamps 33A–C, 34A–C, 43A–C, and 44A–C operate similarly to clamp 43B, however, some are of a different size. Extension clamp 43B comprises a first section 60 and a second section 61 which extend up from inside surface 42. At the ends of the first section 60 and the second section 61, furthest from inside surface 42, a pair of clips 62 and 63, are provided for positive engagement of a dart component. When dart tip 14B, or some other appropriate part of a dart, is inserted into clamp 43B, clip 62 and clip 63 elastically deflect apart until the largest part of the diameter of dart tip 14B extends past the clips 62 and 63. The clamps 43B then elastically returns to its original position such that dart tip 14B is adequately secured in clamp 43B between the first and second sections 60, and 61.

Figure 8:
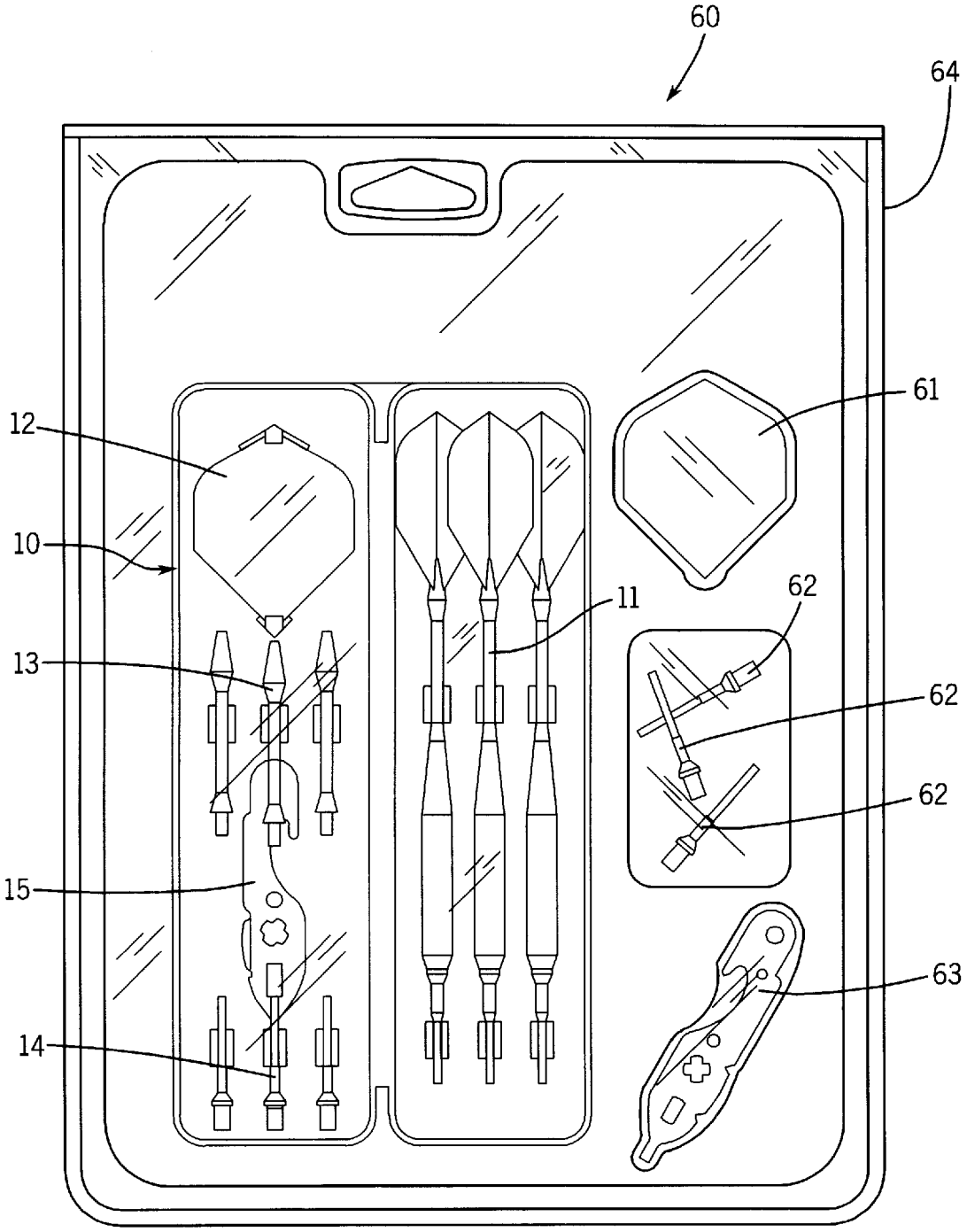
FIG. 8 shows a kit which includes the dart case of FIG. 1, darts, dart components, a dart assembly tool, spare dart flights, tips and shafts, and a spare tool.

In a preferred embodiment, as shown in FIG. 8, the present invention also includes a dart player kit 60 which includes the aforementioned dart case 10 displayed in an open position. The kit further includes a number of darts 11, dart tips 14, dart shafts 13, dart flights 12 and a dart wrench 15 contained therein. The kit also includes extra flights 61, additional spare tips 62 and another dart wrench 63 in container 64 to display the dart case 10 in the open position.

From the foregoing it will be apparent to those skilled in the art that a variety of changes and modifications, outside from those expressly stated, can be made without departing from the spirit of this invention and the scope of the claims.

What is claimed is:

1. A dart case comprising:

a first frame having at least a portion transparent and having a back wall with an inside surface bounded by a side wall and constructed to retain darts therein;

a second frame having at least a portion transparent and having a shape substantially similar to the transparent first frame and having a front wall with an inside surface bounded by a side wall and constructed to retain dart components therein;

a living hinge integrally molded to and connecting a portion of the side wall of the first frame to a portion of the side wall of the second frame, wherein the first frame and the second frame have relative movement and form an enclosure when the side wall of the first frame and the side wall of the second frame are mated; and at least one tool fastener integrally molded to the dart case wherein the at least one tool fastener comprises an arcing member extending outwardly from the inside surface of the second frame and arranged to support a portion of a tool therein.

2. The dart case of claim 1 further comprising a hanging bracket integrally molded to the case, wherein the hanging bracket is capable of being separated from the dart case.

3. The dart case of claim 2 further comprising and having therein at least one dart, at least one spare flight, at least one spare dart shaft, at least one spare tip, and at least one dart assembly tool removably attachable to the dart case to form a dart kit configuration hangable from a display such that all components are viewable to a consumer.

4. The dart case of claim 3 wherein the at least one dart assembly tool is secured within the dart case by the at least one spare dart shaft.

5. The dart case of claim 3 wherein the at least one spare dart shaft is positioned between the at least one spare flight and the at least one spare tip along the length of the inside surface of the front wall of the dart case.

6. The dart case of claim 3 wherein there are three adjacent spare dart shafts secured across the width of the inside surface of the front wall.

7. The dart case of claim 3 wherein there are three adjacent spare tips secured across the width of the inside surface of the front wall.

8. The dart case of claim 3 wherein the first frame and the second frame each have a width to accommodate three elastic clamps connected to and adjacently disposed across each inside surface.

9. The dart case of claim 1 wherein the dart case is an elongated rectilinear shape to retain darts and dart components therein.

10. The dart case of claim 1 further comprising a pair of tool supports located laterally from and adjacent the arcing member, the pair of tool supports extending outward from the inside surface of the second frame and arranged to support the tool a spaced distance from the inside surface.

11. The dart case of claim 1 wherein the side walls are semi-transparent.

12. The dart case of claim 1 further comprising at least one elastic clamp extending outwardly from the inside surface of the back wall.

13. The dart case of claim 1 further comprising at least one fastener attached to the side wall of the first frame which joins with another fastener attached to the side wall of the second frame thereby securing the first frame to the second frame.

14. The dart case of claim 1 comprised of a styrene butadiene copolymer.

15. The dart case of claim 1 wherein the first frame and the second frame each have a width to accommodate three sets of elastic clamps adjacently disposed across each inside surface and capable of retaining three darts in a side-by-side relationship.

16. A dart case comprising:

a first frame having a back wall with an inside surface bounded by a side wall;

a second frame having a shape substantially similar to the first frame and having a front wall with an inside surface bounded by a side wall, wherein the second frame is integrally molded to the first frame such that when the side wall of the first frame and the side wall of the second frame are mated and enclosure is formed;

a dart assembly tool and at least one space dart shaft;

at least one tool fastener extending from the inside surface of the front wall and capable of clamping and minimizing movement of the dart assembly tool and at least one space dart shaft within the dart case; and wherein the dart assembly tool is secured within the dart case by the at least one spare dart shaft.

17. The dart case of claim 16 wherein a living hinge located approximately midway between the back wall of the first frame and the front wall of the second frame integrally connects a portion of the side wall of the first frame to a portion of the side wall of the second frame such that the first frame and the second frame have relative movement to one another.

18. The dart case of claim 16 further comprising a hanging bracket integrally molded with the dart case, wherein the hanging bracket is capable of being separated from the dart case with minimal force.

19. The dart case of claim 16 further comprising at least one elastic clamp extending from the inside surface of the back wall.

20. The dart case of claim 16 further comprising al least one elastic clamp extending from the inside surface of the front wall of the dart case and capable of retaining a spare shaft and wherein the at least one tool fastener comprises a protrusion extending upward from the inside surface of the second frame such that the dart assembly tool is secured between the protrusion and the spare shaft when the spare shaft is retained by the at least one elastic clamp.

21. The dart case of claim 16 further comprising at least one fastener attached to the side wall of the first frame to join with another fastener attached to the side wall of the second frame thereby securing the first frame to the second frame.

22. The dart case of claim 16 comprised of a styrene butadiene copolymer.

23. The dart case of claim 16 further comprising a plurality of v-shaped dart flight retention members extending from the inside surface of the front wall, each dart flight retention member having an angle adapted to receive, and corresponding to an angled edge of, a dart flight such that there is a secure fit when the dart flight is placed between the dart flight retention members and further including a retention cap disposed above each dart flight retention member to further secure the dart flight within the dart case.

24. The dart case of claim 16 wherein the first frame and the second frame have at least portions that are completely transparent.

25. The dart case of claim 16 wherein the first frame and the second frame each have a width to accommodate three elastic clamps connected to and adjacently disposed across each inside surface.

26. A dart case comprising:

a first frame having a back wall with an inside surface bounded by a side wall;

a second frame having a shape substantially similar to the first frame and integrally molded with the first frame and having a front wall with an inside surface bounded by a side wall, wherein the side wall of the first frame and the side wall of the second frame have relative movement and form an enclosure when mated together;

a hanging bracket integrally molded with the dart case at a dart case contact area, the hanging bracket capable of being separated from the dart case with minimal force; and a plurality of v-shaped dart flight retention members extending from the inside surface of the front wall, each dart flight retention member having an angle adapted to receive and corresponding to an angled edge of a dart flight such that there is a secure fit when the dart flight is placed between the dart flight retention members and further including a retention cap disposed above each dart flight retention member to farther secure the dart flight within the dart case.

27. The dart case of claim 26 is comprised of a styrene butadiene copolymer and is substantially transparent.

28. The dart case of claim 26 wherein the first frame and the second frame have at least portions that are fully transparent.

29. The dart case of claim 26 wherein a living hinge connects a portion of the side wall of the first frame to a portion of the side wall of the second frame such that the first frame and the second frame have relative movement to one another.

30. The dart case of claim 26 further comprising:

a dart assembly tool; and at least one tool fastener attached to the inside surface of the front wall capable of supporting the dart assembly tool in the dart case.

31. The dart case of claim 30 further comprising at least one elastic clamp extending from the inside surface of the front wall of the dart case and capable of retaining a spare shaft, and wherein the at least one tool fastener comprises a protrusion integrally molded to the dart case extending upward from the inside surface of the front wall such that the dart assembly tool is secured between the protrusion and the spare shaft when the spare shaft is retained by the at least one elastic clamp.

32. The dart case of claim 26 further comprising at least one elastic clamp extending from the inside surface of the back wall.

33. The dart case of claim 26 further comprising at least one fastener attached to the side wall of the first frame which joins with another fastener attached to the side wall of the second frame thereby securing the first frame to the second frame.

34. A dart kit comprising:

a dart case disposed in an open position including:

a first frame having a back wall with an inside surface bounded by a side wall;

a second frame having a shape substantially similar to the first frame and having a front wall with an inside surface bounded by a side wall, wherein the side wall of the first frame is integrally molded to the second frame such that when the side wall of the first frame and the side wall of the second frame are mated and enclosure is formed;

at least one tool fastener extending from the inside surface of the front wall;

at least one dart;

at least one spare shaft;

at least one spare flight;

at least one spare tip;

at least one dart assembly tool; and a transparent container retaining the dart case in the open position for display.

35. The dart kit of claim 34 wherein the tool fastener within the dart case comprises a protrusion extending upward from the inside surface of the second frame such that the dart assembly tool is secured between the protrusion and at least one spare shaft.

36. The dart kit of claim 34 wherein the first frame and the second frame of the dart case have at least portions that are fully transparent and composed of styrene butadiene copolymer.

37. The dart kit of claim 34 wherein a living hinge integrally connects a portion of the side wall of the first frame to a portion of the side wall of the second frame such that the first frame and the second frame have relative movement to one another.

38. The dart kit of claim 34 wherein the dart case further comprises at least one elastic clamp extending from the inside surface of the back wall.

39. The dart kit of claim 34 wherein the dart case further comprises at least one fastener attached to the side wall of the first frame which joins with another fastener attached to the side wall of the second frame thereby securing the first frame to the second frame.

40. The dart kit of claim 34 wherein the at least one spare shaft is positioned between the at least one spare flight and the at least one spare tip along the length of the inside surface of the front wall of the dart case.

41. The dart kit of claim 34 wherein three spare shafts are adjacently secured across the width of the inside surface of the front wall.

42. The dart kit of claim 34 wherein three spare tips are adjacently secured across the width of the inside surface of the front wall.

43. The dart kit of claim 34 further comprising a plurality of v-shaped dart flight retention members extending from the inside surface of the front wall, each dart flight retention member having an angle adapted to receive and corresponding to an angled edge of a dart flight such that there is a secure fit when the dart flight is placed between the dart flight retention members and further including a retention cap disposed above each dart flight retention member to further secure the dart flight within the dart kit.

44. A dart case comprising a first frame and a second frame, each having an inside surface bounded by a side wall, and a living hinge integrally molded to and connecting a portion of the side wall of the first frame to a portion of the side wall of the second frame, wherein the first frame and the second frame can move relative to one another and form an enclosure when the first and second frames are mated, and further comprising a plurality of v-shaped dart flight retention members extending from the inside surface of the front wall, each dart flight retention member having an angle adapted to receive and corresponding to an angled edge of a dart flight to provide a secure fit when the dart flight is placed between the dart flight retention members and further including a retention cap disposed above each dart flight retention member to further secure the dart flight within the dart case.

45. A dart case comprising:

a transparent first frame having a substantially flat inner surface and a side wall surrounding the substantially flat inner surface, the transparent first frame having a width of approximately three interlaced assembled darts and having a length extending approximately as long as the assembled darts;

a transparent second frame having a substantially flat inner surface and a side wall surrounding the substantially flat inner surface, the transparent second frame having a width of approximately three interlaced assembled darts and having a length extending approximately as long as the assembled dart such that the transparent second frame has a shape substantially similar to the transparent first frame;

a living hinge integrally molded to and connecting a portion of the side wall of the first transparent frame to a portion of the side wall of the transparent second frame, wherein the first frame and the second frame have relative movement and form an enclosure when the side wall of the first transparent frame and the side wall of the transparent second frame are mated, and wherein the living hinge is located approximately midway between the inner surface of the transparent first frame and the inner surface of the transparent second frame; and a plurality of v-shaped dart flight retention members extending from the substantially flat inner surfaces, each dart flight retention member having an angle adapted to receive and corresponding to an angled edge of a dart flight such that there is a secure fit when the dart flight is placed between the dart flight retention members and further including a retention cap disposed above each dart flight retention member to further secure the dart flight within the dart case.

46. The dart case of claim 45 further comprising dual rows of three elastic clamps attached to the transparent first frame across the width of the substantially flat inner surface and adapted to receive three darts.

47. A dart case of claim 45 further comprising dual rows of three elastic clamps attached to the transparent second frame across the width of the substantially flat inner surface and adapted to receive three spare dart shafts and three spare dart tips.

48. A dart kit comprising:

a dart case comprising:

a transparent first frame having a substantially flat inner surface and a side wall surrounding the substantially flat inner surface, the transparent first frame having a width of approximately three interlaced assembled darts and having a length extending approximately as long as the assembled dart;

a transparent second frame having a substantially flat inner surface and a side wall surrounding the substantially flat inner surface, the transparent second frame having a width of approximately three interlaced assembled darts and having a length extending approximately as long as the assembled dart such that the transparent second frame has a shape substantially similar to the transparent first frame;

a living hinge integrally molded to and connecting a portion of the side wall of the first transparent frame to a portion of the side wall of the transparent second frame, wherein the first frame and the second frame have relative movement and form an enclosure when the side wall of the first transparent frame and the side wall of the transparent second frame are mated, and wherein the living hinge in located approximately midway between the inner surface of the transparent first frame and the inner surface of the transparent second frame; and a plurality of v-shaped dart flight retention members extending from the substantially flat inner surfaces, each dart flight retention member having an angle adapted to receive and corresponding to an angled edge of a dart flight such that there is a secure fit when the dart flight is placed between the dart flight retention members and further including a retention cap disposed above each dart flight retention member to further secure the dart flight within the dart case;

a plurality of additional spare flights in spaced relation to the dart case;

a plurality of additional spare dart tips in spaced relation to the dart case;

an additional dart assembly tool in spaced relation to the dart case;

a transparent container enclosing the dart case, the additional spare flights, the additional spare dart tips, and the additional dart assembly tool.

49. The dart kit of claim 48 wherein the dart case further comprises two rows of three elastic clamps attached to the transparent first frame across the width of the substantially flat inner surface and adapted to receive three darts.

50. The dart kit of claim 48 wherein the dart case comprises two rows of three elastic clamps attached to the transparent second frame across the width of the substantially flat inner surface and adapted to receive three spare dart shafts and three spare dart tips.

51. A one-piece unitary dart case comprising:

a first frame having a back wall with an inside surface bounded by a side wall, the inside surface of the first frame having outward extending elastic clamps constructed to releasably retain darts therein and further having a first fastener portion on the side wall;

a second frame having a front wall with an inside surface bounded by a side wall, the inside surface of the second frame having outward extending elastic clamps constructed to releasably retain individual dart components therein and having a second fastener portion on the side wall designed to mate with the first fastener portion of the first frame;

a living hinge integrally molded to a portion of the side wall of the first frame and to a portion of the side wall of the second flame, and connecting the side wall of the first frame to the side wall of the second frame, wherein the living hinge has an elasticity necessary for the first frame and the second frame to move relative to one another and form an enclosure when the side wall of the first frame and the side wall of the second frame are mated together; and wherein the first and second frame, together with the living hinge, are integrally constructed of a single material that is capable of both being transparent and providing the necessary elasticity for providing relative movement of first and second frames, and wherein the first and second frames have substantially planar front and back walls that are transparent such that darts and dart components inside the dart case are visible from a front and a back of the dart case when the dart case is in a closed position; and a first elastic clamp designed to hold a spare dart shaft therein, a second elastic clamp design to hold a spare dart tip therein, and an arcing member extending outwardly from the inside surface of the second frame and located between the first and second elastic clamps such that the arcing member supports a top portion of a tool and the second elastic clamp supports a bottom portion of the tool, and a spare shaft and a spare dart tip mountable in the first and second elastic clamps retain the tool therein.

52. The dart case of claim 51 wherein the side walls of the first and second frames are semi-transparent and each have therein a pair of gripping indentations along a length of the side walls.

53. A dart case comprising:

a transparent first frame having a substantially flat inner surface and a side wall surrounding the substantially flat inner surface, the transparent first frame having a width of approximately three interlaced assembled darts and having a length extending approximately as long as the assembled darts;

a transparent second frame having a substantially flat inner surface and a side wall surrounding the substantially flat inner surface, the transparent second frame having a width of approximately three interlaced assembled darts and having a length extending approximately as long as the assembled dart such that the transparent second frame has a shape substantially similar to the transparent first frame;

a living hinge integrally molded to and connecting a portion of the side wall of the first transparent frame to a portion of the side wall of the transparent second frame, wherein the first frame and the second frame have relative movement and form an enclosure when the side wall of the first transparent frame and the side wall of the transparent second frame are mated, and wherein the living hinge is located approximately midway between the inner surface of the transparent first frame and the inner surface of the transparent second frame; and at least one tool fastener integrally molded to the dart case wherein the at least one tool fastener comprises an arcing member extending outwardly from the inside surface of the second frame and arranged to support a portion of a tool therein.

54. The dart case of claim 53 further comprising a pair of tool supports located laterally from and adjacent the arcing member, the pair of tool supports extending outward from the inside surface of the second frame and arranged to support the tool a spaced distance from the inside surface.

* * * * *